United States Patent [19]

Butterwick

[11] 4,407,857

[45] Oct. 4, 1983

[54] METHOD FOR PROCESSING A LITHIUM-SODIUM-ANTIMONY PHOTOCATHODE

[75] Inventor: Gilbert N. Butterwick, Leola, Pa.

[73] Assignee: RCA Corporation, New York, N.Y.

[21] Appl. No.: 279,182

[22] Filed: Jun. 30, 1981

[51] Int. Cl.[3] ..... H01J 39/00

[52] U.S. Cl. ..... 427/74; 445/9; 445/10; 445/11; 445/12; 445/13; 445/14; 445/15; 445/16; 445/17

[58] Field of Search ..... 445/9, 10, 11, 12, 13, 445/14, 15, 16, 17; 427/74

[56] References Cited

U.S. PATENT DOCUMENTS

| | | | |
|---|---|---|---|
| 1,381,474 | 6/1921 | Kung | 313/100 |
| 1,776,993 | 9/1930 | Burt | 204/20 |
| 1,871,280 | 8/1932 | Rentschler | 313/101 |
| 1,881,616 | 3/1932 | Ives | 313/101 |
| 2,676,282 | 4/1954 | Polkosky | 313/102 |
| 2,770,561 | 11/1956 | Sommer | 117/211 |
| 3,023,131 | 2/1962 | Cassman | 117/210 |
| 3,372,967 | 3/1968 | Hughes | 316/5 |
| 3,434,876 | 3/1969 | Stoudenheimer | 117/211 |
| 3,658,400 | 4/1972 | Helvy | 313/94 |
| 3,838,304 | 9/1974 | McDonie | 313/94 |
| 4,305,972 | 12/1981 | McDonie | 427/74 |
| 4,376,246 | 3/1983 | Butterwick | 250/207 |

OTHER PUBLICATIONS

A. Sommer, *Photoemissive Materials,* Wiley and Sons, Inc., 1968, pp. 108–114.

*Primary Examiner*—John D. Smith
*Assistant Examiner*—Kenneth Jaconetty
*Attorney, Agent, or Firm*—Eugene M. Whitacre; Dennis H. Irlbeck; Vincent J. Coughlin, Jr.

[57] ABSTRACT

A method is provided for making a lithium-sodium-antimony photocathode including the step of forming a base layer including antimony on a substrate. Sodium is then deposited onto the base layer at an elevated temperature to a first peak value of responsivity, thereby forming a sodium-antimony surface. Next, at room temperature, lithium is deposited onto the substrate containing the sodium-antimony surface until the lithium-sodium-antimony photocathode develops a hazy brown color. The photocathode is sensitized by heating the substrate to an elevated temperature until a second peak value of responsivity, greater than the first peak value, is obtained. Antimony, sodium and lithium are then alternately deposited on the photocathode in order to stabilize the second responsivity peak.

4 Claims, 4 Drawing Figures

METHOD FOR PROCESSING A LITHIUM-SODIUM-ANTIMONY PHOTOCATHODE

BACKGROUND OF THE INVENTION

This invention relates to photocathodes and more particularly to a method for forming a photocathode which exhibits improved high temperature operating characteristics.

A previous type of photoemitting surface is a semi-transparent multialkali photocathode such as described in U.S. Pat. Nos. 2,770,561 to A. H. Sommer and U.S. Pat. No. 3,372,967 to F. R. Hughes. Generally, photocathodes of this type which have been sensitized with cesium (cesiated photocathodes) have substantially higher sensitivities of response than noncesiated photocathodes. However, such cesiated photocathodes have been found inadequate for certain applications. For example, photomultiplier tubes having cesiated photocathodes have been used for scintillation counting, in applications, such as, for example, geophysical exploration in which the ambient temperature of operation approaches 150° C. At such temperatures, the cesiated photocathode appears to decompose and the expected useful life of the device is severely restricted. Moreover, high temperature operation in general, above 85° C., of conventional photomultiplier tubes with noncesiated photocathodes, tends to make the tube extremely sensitive to higher operational voltages, which, if applied to the device, are known to cause spurious scintillation counts and general instability of the processed signal, due to regenerative effects within the tube. An improved noncesiated photocathode comprising potassium, sodium and antimony is described in U.S. Pat. No. 3,828,304 to McDonie. The McDonie bialkali photocathode operates satisfactorily to ambient temperatures of about 175° C.; however, the photocathode appears to decompose as the temperature approaches 200° C. Present geophysical exploration requirements demand a stable photocathode that will survive ambient temperatures of about 200° C.

SUMMARY OF THE INVENTION

A method is provided for making a lithium-sodium-antimony photocathode including the step of forming a base layer including antimony on a substrate. Sodium is then deposited onto the base layer to form a sodium-antimony surface. Lithium is subsequently deposited onto the sodium-antimony surface to form a photocathode. Next, the photocathode is sensitized until a peak value of responsivity is obtained. Then, antimony, sodium and lithium are alternately deposited onto the photocathode until the responsivity peak is stabilized.

DETAILED DESCRIPTION OF THE PREFERRED EMBODIMENT

Figure 1:
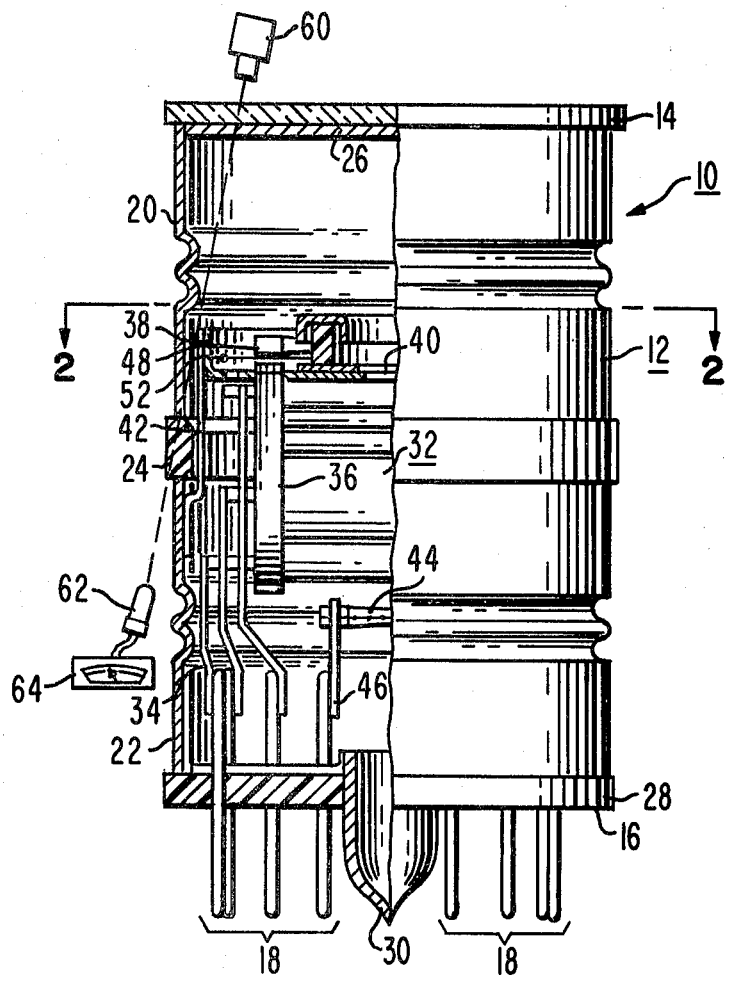
FIG. 1 is an enlarged view, partially in section, of a photomultiplier tube having a photocathode formed in accordance with the present method.
Figure 2:
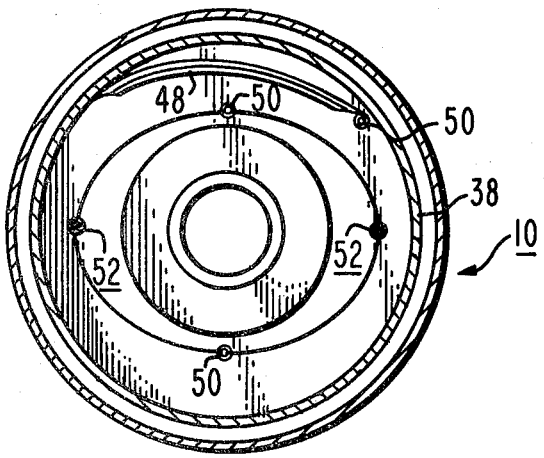
FIG. 2 is a view along lines 2—2 of FIG. 1 showing the orientation of the lithium retainer.

Referring to the drawings, there is shown in FIGS. 1 and 2 a photomultiplier tube 10 comprising an evacuated envelope 12 having a generally cylindrical shape. The envelope 12 is closed at one end by a transparent faceplate 14 and at the other end by a stem section 16 through which a plurality of support leads 18 are sealed. Although the envelope 12 may comprise a glass cylinder, a structure that will not react with lithium vapor is preferred. Such a structure is described in my copending patent application, Ser. No. 227,342, U.S. Pat. No. 4,376,246 filed Jan. 22, 1981 and incorporated herein for purpose of disclosure. The above-referenced copending application is assigned to the same assignee as the present invention. In the preferred embodiment of FIG. 1, the envelope 12 includes a cathode subassembly 20 and a stem subassembly 22. The subassemblies comprise metal wall portions. The cathode subassembly 20 is separated from the stem subassembly 22 by a ceramic member 24 brazed between the cathode and stem subassemblies. A photoemissive cathode (hereinafter called the photocathode) 26 is formed on the interior surface of the faceplate 14. The photocathode 26 provides photoelectrons in response to radiation incident thereon. The faceplate 14 is shown to be a plano-plano window, for example of sapphire or other suitable materials although sapphire is preferred. The sapphire faceplate 14 provides a reasonable cost, non-reactive substrate on which to form the photocathode 26. The stem 16 is a ceramic-metal structure comprising a ceramic base 28 and a metal tubulation 30. The metal tubulation 30 is preferably made of copper alloy which may be cold-welded, as shown, subsequent to photocathode formation, to form a vacuum seal. The tubulation 30 is brazed to the ceramic plate 28 by a method well known in the art. The stem leads 18 extend through the ceramic plate 28 and are vacuum sealed thereto, e.g., by brazing.

An electron multiplier cage assembly, indicated generally as 32, is supported within the envelope 12 by a plurality of cage leads 34 (only some of which are shown). The cage leads 34 are attached at one end to the internally projecting stem leads 18. The cage assembly 32 comprises a plurality of dynodes supported between a pair of dynode support spacers 36, only one of which is shown. The dynodes comprise secondary emissive electrodes for propagating and concatenating electron emission from the photocathode 26 to an anode (not shown) enclosed within the last dynode. For high temperature operation, dynodes formed from a beryllium copper alloy and having a beryllium-oxide secondary emissive surface are preferred.

The dynode support spacers 36 are attached to a support electrode 38 which is spaced from the faceplate 14. The support electrode 38 is preferably a cup-shaped conductive member having a substantially flat base and a centrally disposed aperture 40 extending therethrough. Electrical connection between the envelope wall 12 and the support electrode 38 is provided by a connecting strap 42.

A sodium generator 44, comprises a retainer formed by spirally rolling a thin sheet of tantalum foil upon itself and spot welding the overlapping seam. The sodium generator 44 contains sodium chromate, zirconium and tungsten within the retainer. The sodium generator 44 is suitably connected between a pair of internal leads 46, only one of which is shown. A lithium generator 48 comprises a tantalum retainer, formed as described above, containing lithium chromate, zirconium and tungsten positioned within the support electrode 38. As best shown in FIG. 2, the lithium generator 48 is attached at one end to the support electrode 38 and at the other end to a processing lead 50 which is insulated from and extends through the support electrode 38. A pair of antimony evaporators 52, comprising a platinum-antimony alloy bead of about 50 percent antimony and 50 percent platinum, by weight, attached to a platinum-clad molybdenum wire filament, are secured between a pair of insulated processing leads 50. The internal leads 46, attached to the sodium generator 44, and the processing leads 50, attached to the lithium generator 48 and to the antimony evaporators 52, are suitably connected to external electrical current sources (not shown) through support leads 18, so that the generators and the evaporators can be activated separately by electrical resistance heating.

The tantalum foil retainer of the lithium generator 48 is oriented so that the overlapping seam of the retainer is directed toward the faceplate 14. Since lithium has a lower vapor pressure than sodium, this orientation of the retainer seam ensures that lithium metal is deposited on the faceplate. The lower vapor pressure of lithium also ensures that the lithium-sodium-antimony photocathode is more resistant to decomposing at high temperature than other commonly known bialkali and multialkali photocathodes. Sodium, with a higher vapor pressure than lithium, readily diffuses throughout the tube so the sodium generator 44 does not require line-of-sight orientation with respect to the faceplate 14.

Figure 3:
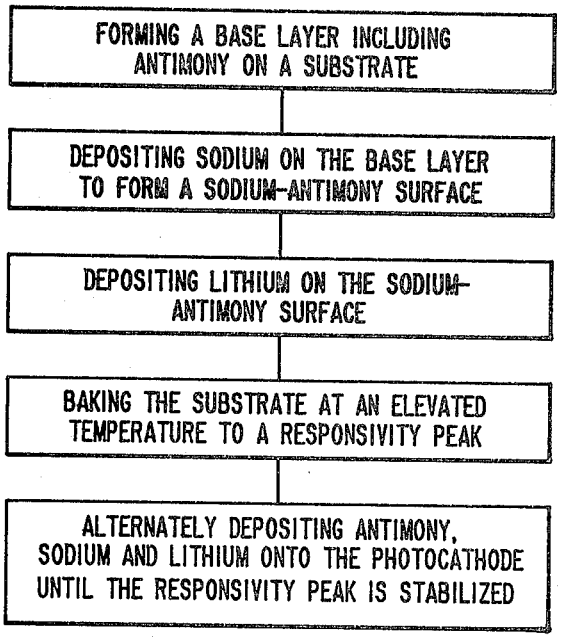
FIG. 3 is a flow chart showing the steps in the formation of the photocathode of FIG. 1.

The photocathode 26 is made in accordance with the following procedure which is summarized in the flow chart shown in FIG. 3. The tubulation 30 is connected, prior to tip-off, to an exhaust system (not shown) and the tube envelope 12 is evacuated until the pressure within the envelope 12 is of the order of $10^{-6}$ torr or less. The tube 10 is then baked between 375°–400° C. for about two hours to remove occluded gases from the interior tube components. The tube is then cooled at 5°14 10° C. per minute to room temperature.

At room temperature (about 23° C.), a thin film of antimony is deposited onto the faceplate 14 from the antimony evaporators 52. In order to form the antimony layer, a variable intensity light source 60 is arranged above the faceplate 14 and the light is directed into the tube and through the ceramic member 24 onto a photodetector 62 which is connected to an amplifying device 64 having a graduated dial indicating a current flow proportional to the amount of light from the source 60. The indicator can be adjusted to show a scale reading of 100 at full transmission of light through the ceramic member 24. While the envelope 12 is still evacuated, a current is passed through the antimony evaporators 52 to heat and evaporate antimony from the platinum-antimony beads. The evaporated antimony will condense upon the faceplate 14 to form a thin coating. The antimony is evaporated until the light transmission from the source 60 through the envelope has been reduced to 90 percent as indicated by device 64. This thickness of the antimony film is not critical and may range from 85 percent transmission to 95 percent transmission.

Oxygen is next introduced into the envelope 12 through the tubulation 30 to a pressure of about 300–380 microns. The antimony film is then oxidized by using a high frequency electrode (not shown) placed over the faceplate 14. The high frequency of the electrode produces within the envelope 12 a gaseous discharge which causes the antimony to react with the oxygen in the envelope. The electrode is held over the faceplate for about 2 to 20 seconds. This method of oxidizing metal films within the envelope is well known and completely described in U.S. Pat. No. 2,020,305 to Essig, issued on Nov. 12, 1935 and incorporated herein for purpose of disclosure. The oxygen within the envelope is then removed and the reading of indicator device 64 is reset to 100 by adjusting either the intensity of the light source 60 or the sensitivity of the device 64. The oxidized antimony provides a barrier when the faceplate 14 is made of glass. The barrier prevents an interaction between the lithium and the glass faceplate.

A second layer of antimony is next put down over the oxidized antimony surface, also by passing a current through the evaporator assemblies 52 and evaporating antimony from the platinum-antimony beads to form a base layer. The evaporation of antimony is continued until the light transmission through the faceplate is about 60 percent as indicated by the device 64. This thickness of antimony is not critical and may range from 50 percent transmission to 80 percent transmission. The method of monitoring the transmission of metal films deposited on transparent substrates is well known and described in detail in U.S. Pat. No. 2,676,282 to Polkosky, issued on Apr. 20, 1954 and incorporated herein for purpose of disclosure.

The responsivity, sometimes called the photoemissive sensitivity, of the photocathode is defined as the ratio of the output current of the photoemissive surface or device to the input flux in watts or lumens. For example, as applied to photomultiplier tubes, the radiant responsivity is expressed in milliamperes per watt (mA/W) at a specific wavelength or luminous responsivity is expressed in microamperes per lumen (μA/lm).

The responsivity of the photocathode 26 is monitored by collecting the emitted photoelectrons with one or more of the internal tube elements, such as the support electrode 38. Structures for monitoring photocathode responsivity are disclosed in U.S. Pat. No. 3,434,876 to Stoudenheimer et al. and U.S. Pat. No. 3,658,400 to Helvy incorporated herein for disclosure purpose. For such collection, the electrode 38 is impressed with a voltage of between 50 and 150 volts positive with respect to the photocathode 26. A microammeter (not shown) is connected in series with the source of the voltage. Electrical connection to the photocathode 26 is made by attaching one lead to the metal housing of the cathode subassembly 20 with the other lead attached to the stem subassembly 24 which is connected to electrode 38 through connecting strap 42. A light source (not shown) is incident on the faceplate during the photocathode processing or sensitizing steps described hereinafter.

During the deposition of the above-described base layer, formed on the faceplate 14, the tube is continuously evacuated through the tubulation 30. Next, the tube 10 is heated to about 220° C. by lowering an oven over the evacuated tube. When the tube temperature stabilizes at 220° C., a gradually increasing evaporation current is passed through the sodium generator 44 to resistively heat the generator 44 until sodium vapor is evolved. The current through generator 44 is adjusted to provide a constant flow of sodium vapor to the base layer on the faceplate 14. The evaporation current is held constant and the photocathode responsivity is monitored. The sodium evaporation is continued until the photoemissive sensitivity reaches a peak value and decreases to 90 percent of that peak. The sodium-antimony reaction forms a sodium-antimony polycrystalline layer having a transparent golden color on the faceplate 14.

The tube is then cooled to room temperature by raising the oven. When the tube reaches room temperature, an evaporation current is passed through the lithium generator 48 until lithium vapor is evolved. The lithium evaporation is continued until the lithium deposit on the polycrystalline layer on the faceplate 14 appears to develop a cloudy or hazy brown color. The lithium evaporation current is turned off when the hazy brown color appears indicating that a sufficient quantity of lithium has been deposited on the sodium-antimony layer.

The oven is again lowered over the tube and the oven temperature is increased to provide a tube temperature of 220° C. When the tube 10 reaches 220° C., the photocathode responsivity is monitored until a peak in photoemissive sensitivity greater than the previously obtained sodium photoemissive sensitivity peak is obtained. Generally a peak value of sensitivity will be reached and then the photoemissive sensitivity will begin to decrease. As the sensitivity begins to decrease, small quantities of antimony, sodium and lithium are alternately deposited to stabilize the photocathode 26. When the photoemissive sensitivity reaches a peak value and appears to be stable, the tube is cooled at a rate of about 5° C. per minute to about 100° C., then freely cooled to room temperature and tipped-off by crimping the tubulation 30.

Figure 4:
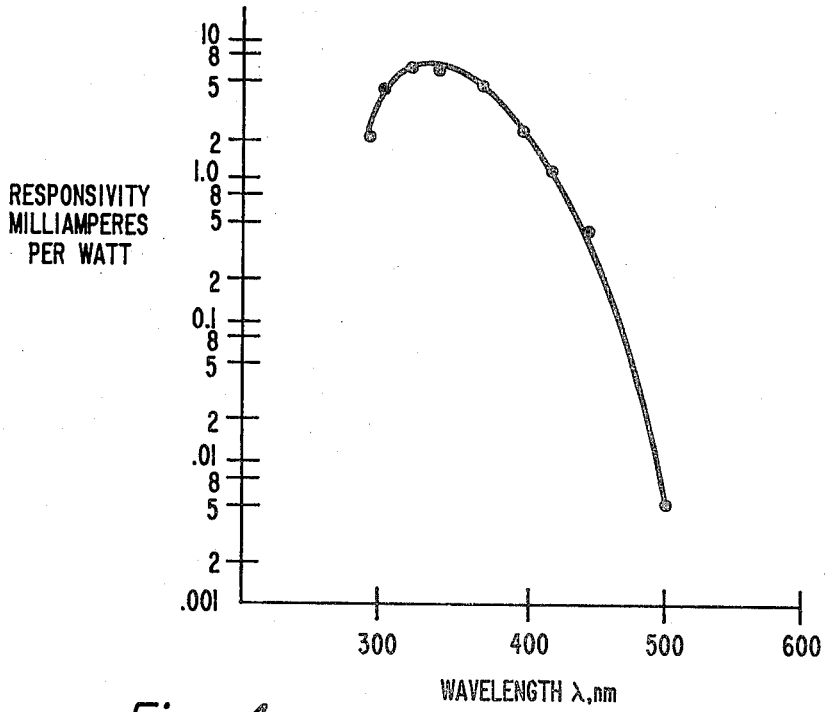
FIG. 4 is a graph showing the responsivity of the photocathode, in milliamperes per watt, versus the wavelength of radiation incident on the photocathode.

A spectral response curve showing the photocathode responsivity versus wavelength for a tube having a lithium-sodium-antimony photocathode processed by the above-described method is shown in FIG. 4. The spectral response of the photocathode provides a good match with the emission from a sodium iodide scintillation crystal used in geothermal exploration. The absence of red response, i.e., no responsivity above 610 nonometers (nm), in the lithium-sodium-antimony photocathode effectively reduces thermal noise associated with high temperature tube operation. While the responsivity of the lithium-sodium-antimony photocathode at room temperature is relatively low, as shown in FIG. 4, the cathode has sufficient sensitivity and stability at temperatures on the order of 200° C. to be superior to the conventional potassium-sodium bialkali photocathode and the cesiated photocathodes.

What is claimed is:

1. A method of making a lithium-sodium-antimony photocathode comprising in order:

(a) forming a base layer including antimony on a substrate, (b) depositing sodium onto said base layer such that the responsivity of the resultant sodium-antimony surface increases to a first peak value and then decreases to 90 percent of said peak value, (c) depositing lithium onto said sodium-antimony surface until said lithium-sodium-antimony photocathode developes a hazy brown color, (d) sensitizing said lithium-sodium-antimony photocathode until a second peak value greater than said first peak is obtained, and (e) alternately depositing antimony, sodium and lithium onto said photocathode until said second peak is stabilized.

2. The method as in claim 1, wherein said steps a and c are carried out while said substrate is maintained at room temperature, and said steps b, d and e are carried out while said substrate is maintained at about 220° C.

3. The method as in claim 1, further including the steps of:

(i) cooling said substrate from the temperature at which step e is carried out, said cooling being at a rate of about 5° C. per minute to a temperature of about 100° C., and (ii) freely cooling said substrate to room temperature.

4. A method of making a lithium-sodium-antimony photocathode comprising in order:

(a) forming a base layer including antimony on a substrate at room temperature, (b) depositing sodium onto said base layer while said substrate is maintained at about 220° C. such that the responsivity of the resultant sodium-antimony surface increases to a first peak value and then decreases to 90 percent of said peak value, (c) depositing lithium onto said sodium-antimony surface while said substrate is maintained at room temperature until said lithium-sodium-antimony photocathode develops a hazy brown color, (d) sensitizing said lithium-sodium-antimony photocathode by heating said substrate to about 220° C. and maintaining that temperature until a second peak value greater than said first peak is obtained.

(e) alternately depositing antimony, sodium and lithium onto said photocathode while said substrate is maintained at 220° C. until said second peak is stabilized, and (f) cooling said substrate from 220° C. at a rate of about 5° C. per minute to about 100° C. and then freely cooling said substrate to room temperature.

* * * * *

UNITED STATES PATENT AND TRADEMARK OFFICE

CERTIFICATE OF CORRECTION

PATENT NO. : 4,407,857

DATED : October 4, 1983

INVENTOR(S) : Gilbert Nason Butterwick

It is certified that error appears in the above-identified patent and that said Letters Patent is hereby corrected as shown below:

Column 1, Line 37 - "Pat. No. 3,828,304" should be -- Pat. No. 3,838,304 -- ; and Column 3, Line 42 - "5°14 10°C." should be -- 5-10°C -- .

Signed and Sealed this

*Fifteenth* Day of *May 1984*

[SEAL]

*Attest:*

GERALD J. MOSSINGHOFF

*Attesting Officer*

*Commissioner of Patents and Trademarks*